US009452436B2

(12) United States Patent
Ballhause

(10) Patent No.: US 9,452,436 B2
(45) Date of Patent: Sep. 27, 2016

(54) DRIVE HEAD FOR DETACHABLE CONNECTION OF A DRIVE WITH A ROTOR OF A CENTRIFUGE, KIT COMPRISING THE DRIVE HEAD, AND CENTRIFUGE

(71) Applicant: Thermo Electron LED GmbH, Langenselbold (DE)

(72) Inventor: Norman Ballhause, Windhausen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 14/723,726

(22) Filed: May 28, 2015

(65) Prior Publication Data

US 2015/0343459 A1 Dec. 3, 2015

(30) Foreign Application Priority Data

May 28, 2014 (DE) ..... 10 2014 008 219

(51) Int. Cl.
*B04B 9/00* (2006.01)
*B04B 9/08* (2006.01)

(52) U.S. Cl.
CPC . *B04B 9/00* (2013.01); *B04B 9/08* (2013.01); *B04B 2009/085* (2013.01)

(58) Field of Classification Search
CPC ..... B04B 9/08; B04B 2009/085; B04B 9/00
USPC ..... 494/12, 16, 20, 33, 38, 64, 84, 85; 210/232
See application file for complete search history.

(56) References Cited

U.S. PATENT DOCUMENTS 4,193,538 A 3/1980 Schwarz
6,063,018 A * 5/2000 Letourneur ..... B04B 9/08 403/327
8,678,987 B2 * 3/2014 Henne ..... B04B 9/08 494/12
8,852,070 B2 * 10/2014 Peters ..... B04B 9/08 494/12
9,339,824 B2 * 5/2016 Henne ..... B04B 9/08
2011/0212822 A1 9/2011 Henne (Continued)

FOREIGN PATENT DOCUMENTS

DE 2722322 A1 11/1978
DE 19930593 A1 * 4/2000 ..... B04B 9/08

(Continued)

OTHER PUBLICATIONS

UK Intellectual Property Office, Combined Search and Examination Report under Sections 17 and 18(3), Application No. GB1508086.4, mailed Aug. 20, 2015 (5 pages).

*Primary Examiner* — Charles Cooley
(74) *Attorney, Agent, or Firm* — Wood, Herron & Evans, LLP

(57) ABSTRACT

The present invention relates to a drive head for detachable connection of a drive with a rotor of a centrifuge, comprising a base body, which is rotatable about an axis of rotation (R) and at least two coupling elements, which are mounted on the base body so as to be able to swivel out to the outside about a respective swivel axis. The swivel axes are tilted at an angle (α) with respect to the axis of rotation (R), and the coupling elements have a resting surface at their swiveling end, which extends perpendicularly to the axis of rotation (R). The present invention further relates to a kit comprising the drive head and a centrifuge comprising the drive head or the kit.

17 Claims, 3 Drawing Sheets

(56) References Cited

U.S. PATENT DOCUMENTS

| | | | | |
|---|---|---|---|---|
| 2013/0188894 | A1* | 7/2013 | Peters | B04B 9/08 384/91 |
| 2013/0237399 | A1* | 9/2013 | Letourneur | B04B 9/08 494/10 |
| 2013/0331253 | A1* | 12/2013 | Ballhause | B04B 9/00 494/84 |
| 2015/0231648 | A1* | 8/2015 | Henne | B04B 9/08 494/84 |
| 2015/0343459 | A1* | 12/2015 | Ballhause | B04B 9/00 494/43 |
| 2016/0107171 | A1* | 4/2016 | Bittner | B04B 9/08 |
| 2016/0158769 | A1* | 6/2016 | Hornek | B04B 9/08 |

FOREIGN PATENT DOCUMENTS

| | | | | |
|---|---|---|---|---|
| DE | 102008045556 | A1 | 3/2010 | |
| DE | 202010014803 | U1 | 2/2011 | |
| DE | 102012011531 | A1 | 12/2013 | |
| EP | 0911080 | A1 | 4/1999 | |
| FR | 3005273 | A1 * | 11/2014 | B04B 9/08 |
| GB | 2502894 | A | 12/2013 | |
| JP | 2601042 | B2 * | 4/1997 | |
| WO | 2011/001729 | A1 * | 1/2011 | |
| WO | 2011001729 | A1 | 1/2011 | |
| WO | 2011/054906 | A1 * | 5/2011 | |

* cited by examiner

FIG. 4
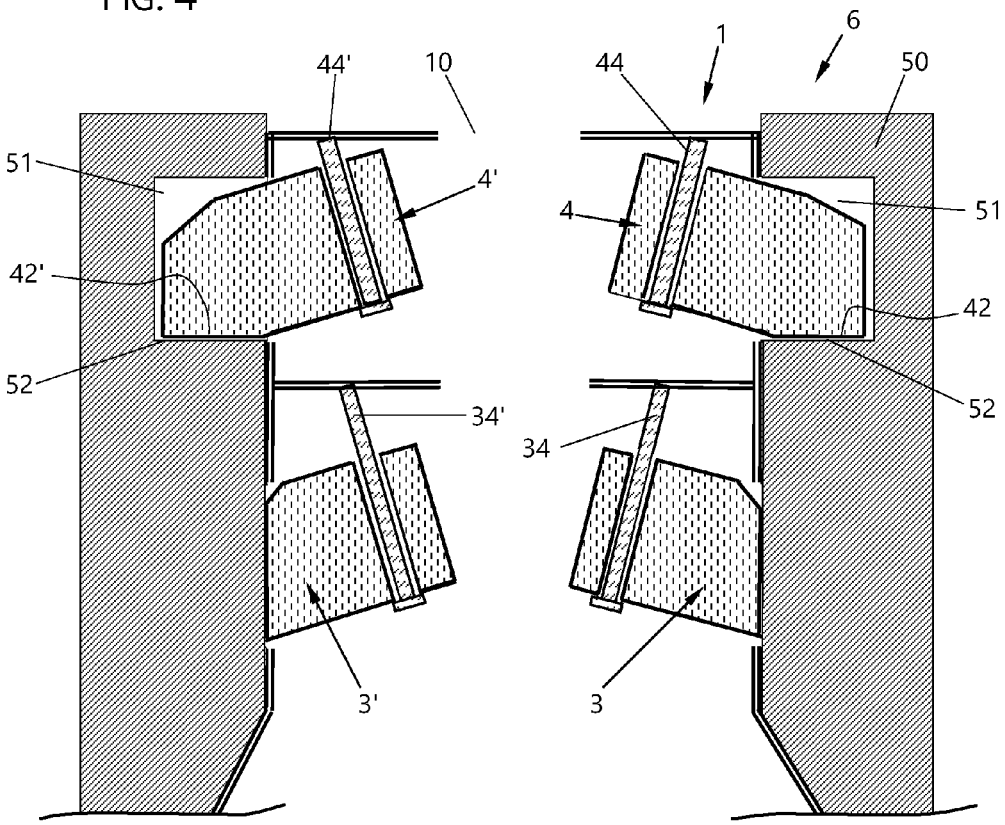
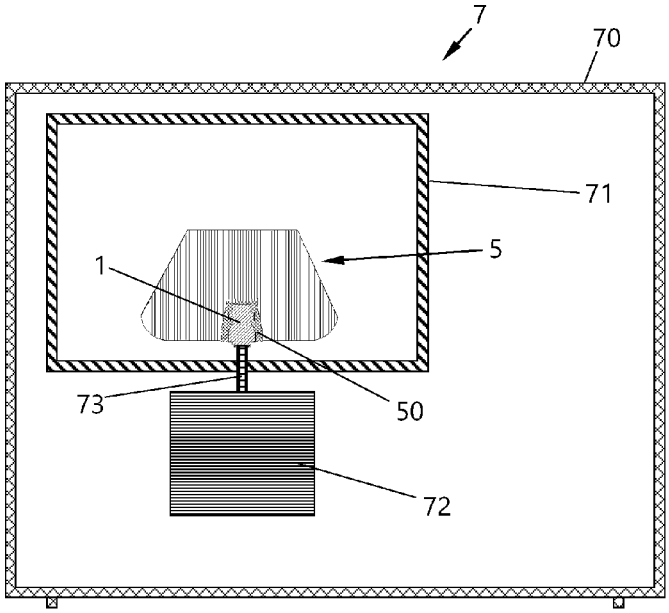
FIG. 5

DRIVE HEAD FOR DETACHABLE CONNECTION OF A DRIVE WITH A ROTOR OF A CENTRIFUGE, KIT COMPRISING THE DRIVE HEAD, AND CENTRIFUGE

CROSS-REFERENCE TO RELATED APPLICATIONS

The present application claims priority under 35 U.S.C. §119 of German Patent Application No. 10 2014 008 219.9, filed May 28, 2014, the disclosure of which is hereby incorporated herein by reference in its entirety.

FIELD OF THE INVENTION

The present invention relates to centrifuges that hold sample containers and are used for separating the constituents of the samples contained therein at a high rotational speed of a centrifuge rotor. More particularly, the present invention relates to a drive head for detachable connection of a drive with a rotor of a centrifuge, which drive head comprises a base body and at least two coupling elements, which are mounted on the base body so as to be able to swivel between a release position and a locking position. The coupling elements protrude further beyond the outer circumference of the base body in the locking position than in the release position and come to rest against the rotor, thereby locking the rotor to the drive head in such a way that the former cannot be removed from the latter. The present invention further relates to a kit for a centrifuge, which kit consists of a drive head and at least one hub for a rotor. Finally, the present invention also relates to a centrifuge comprising the drive head or the kit.

BACKGROUND OF THE INVENTION

The prior art discloses a number of solutions by means of which a rotor of a centrifuge can be mounted firmly on a drive shaft. For example, it is known to press the rotor onto a conical seat of a drive shaft with a screw thread.

Self locking attachments are also known, for example, from EP 0 911 080 A1. However, the described system is suitable only for specific rotor types that do not generate any forces (for example, buoyancy forces) contrary to the coupling direction.

DE 10 2008 045 556 A1 develops the concept of EP 0 911 080 A1 and uses swiveling coupling elements for locking, which produce a self-locking effect already in an idle state of the rotor due to inclined friction surfaces, so that unintended axial unlocking is prevented. In case of very high rotational speeds, however, the rotor may get jammed due to the high centrifugal forces, and the coupling cannot always be easily released.

DE 10 2012 011 531 A1 discloses a versatile system suitable for mounting a great variety of different rotors on a drive head in a self-locking manner. The drive head has various types of coupling elements, which swivel into associated recesses in the rotor either separately or in combination with each other depending on the respective rotor to be connected. The self-locking is achieved by appropriate arrangement of sloped ramp faces on the coupling elements and the rotor. In terms of manufacturing, this is relatively expensive.

SUMMARY OF THE INVENTION

It is thus an object of the present invention to overcome the disadvantages of the prior art mentioned above. More particularly, it is an object of the present invention to provide a drive head comprising a self-locking and quickly detachable coupling as well as a kit for a centrifuge and a centrifuge comprising said drive head, which can be manufactured at a lower cost without any loss in terms of reliability and ease of operation.

According to a first aspect, the present invention relates to a drive head for detachable connection of a drive with a rotor of a centrifuge, which drive head comprises a base body which is rotatable about an axis of rotation, and at least two coupling elements, which are mounted on the base body so as to be able to swivel out. The coupling elements can thus be moved between a release position and a locking position and protrude further beyond the outer circumference of the base body in the locking position than in the release position. The locking takes place basically as in the case of DE 10 2012 011 531 A1 or DE 10 2008 045 556 A1 in that the coupling elements, protruding beyond the outer circumference of the base body in their locking position, engage the rotor and, by way of this engagement, fix the rotor to the drive head.

In contrast to the aforementioned publications, the coupling elements according to the present invention are however oriented differently. More specifically, their swivel axes are tilted at an angle not equal to 90° with respect to the axis of rotation about which the drive head rotates and which is normally oriented vertically. Correspondingly, the swiveling movement of the coupling elements does not take place horizontally, but in a plane that is tilted relative to the horizontal plane. The resting surface, which is located at the swiveling end of the coupling elements and via which the respective coupling element comes in contact with the hub of the rotor and locks the latter, is designed in such a way that it extends in a horizontal plane perpendicular to the axis of rotation. Thus, the locking surface of the rotor hub can likewise be designed as a horizontal surface, which significantly simplifies the manufacturing and reduces the cost.

The plane in which a coupling element swivels out in the direction towards the rotor in order to lock it with the drive head preferably extends in a downward slope as regarded from the mounting side of the rotor. Correspondingly, the swivel axis, about which the coupling element swivels, is tilted outwardly with respect to the axis of rotation towards the mounting side of the rotor. Thus, when swiveled out to the locking position, the swiveling end of the coupling element slopes away from the mounting side of the rotor. The resting surface, via which the coupling element comes in contact with the rotor hub, is suitably located on that side of the coupling element facing away from the mounting side.

The inclination angle between the swivel axis of the respective coupling element and the axis of rotation is selected appropriately depending on the materials of the coupling elements and the rotor hub. This is done under consideration of the friction coefficients of the resting surface of the coupling element on the one hand and the associated locking surface of the rotor hub, on which the resting surface of the coupling element comes to rest, on the other hand. The stability of the self-locking that results from the contact of the resting surface of a coupling element with the associated locking surface of the rotor hub depends on the selected material combination on the one hand and on the angle at which the two contact surfaces are pressed against each other on the other hand. As described in DE 10 2008 045 556 A1 with reference to FIGS. 3 and 4, self-locking occurs if the angle $\alpha$, which describes the inclination of the contact surface, is smaller than arc tan $\mu_0$, wherein $\mu_0$ is the friction coefficient of the material combination used. Normally, steel is used for the coupling elements as well as for the rotor and its hub. The friction coefficient $\mu_0$ for a steel/steel combination is 0.3 for dry surfaces. This means that, with respect to the present invention, a particularly preferable inclination angle $\alpha$ of the swivel axis relative to the axis of rotation is at most 17°, and, in particular, in the range of 13 to 17°. However, for other material combinations other inclination angles $\alpha$ may be selected. Overall, preferred inclination angles for the present invention range from 5 to 30° and, more preferably, from 10 to 20°. Due to the coupling element coming to rest on the locking surface of the rotor at an altogether steeper angle, more from above compared to the horizontal swiveling described in the prior art, the self-locking can be improved still further and the risk of the contact surfaces getting jammed is reduced. This allows for selecting larger inclination angles than before without the risk of self-unlocking.

The inclined arrangement of the coupling elements allows for the resting surface with which the coupling element rests on the rotor to be designed horizontally. Accordingly, the at least one locking surface of the rotor, on which the resting surfaces of the coupling elements come to rest, can likewise be constructed horizontally. This facilitates the manufacturing of the rotor and reduces the cost considerably. For example, the locking surface in the rotor can be created in that a circular groove of rectangular cross-sectional shape in the radial direction is milled, or, otherwise, worked into the lateral surface of the rotor hub which surrounds the central opening in the rotor for accommodating the drive head. Alternatively, the resting surfaces of the coupling elements can simply come to rest on a top edge of the hub of the rotor and in this manner lock the rotor to the drive head. In each case, the creation of the horizontal locking surfaces is considerably simpler than creating the same with a particular inclination, as was necessary in the prior art.

Apart from the inclined arrangement with tilted swivel axes, the coupling elements may otherwise correspond to those already described in DE 10 2008 045 556 A1 and DE 10 2012 011 531 A1. For example, the coupling elements may taper in the direction towards the swiveling end, wherein they, more particularly, have an upper cover face pointing in the direction towards the mounting side of the rotor and extending at a downward slope in the direction towards the swiveling end. This results in a roughly wedge-like overall shape.

The at least two coupling elements of the drive head may be identical or differ from each other. In one variant of the present invention, two or three identical coupling elements are evenly distributed in the circumferential direction and, in particular, at the same level of the drive head around its outer circumference in order to ensure uniform and tilt free arresting of the rotor. However, it is also possible to use non-identical coupling elements, as described in DE 10 2012 011 531 A1. The latter is particularly preferred for more than two and especially more than three coupling elements, of which at least one is located at a different level of the drive head compared to the other ones. If at least two coupling elements differ from each other, they preferably differ with respect to at least one of the following characteristics: their external shape, their mass, their material or the level at which they are mounted on the base body with respect to the axis of rotation. It is particularly preferred that one of the coupling elements is larger and/or heavier than the other one.

As is already known from the prior art, the coupling elements are appropriately arranged in a respective suitable recess in the base body in such a way that in the release position they are completely accommodated in the recess and as much as possible are flush with the outer contour of the base body accommodating them. The coupling elements are suitably provided with an elastic element such as a spring, which pushes them to the locking position. In this way, an automatic locking is possible if the rotor is in the locking position on the drive head. To release the rotor from the drive head, the coupling elements need to be pushed back against the spring force from the locking position to the release position. For this purpose, a release device can be used, with which the coupling elements can be pushed back from the locking position to the release position against the spring force. The release device can, for example, be constructed as suitable positioning elements, for example, sliders, as generally already known in the prior art.

The basic shape of the drive head itself may also correspond to the shape of the drive heads known in the art. As regarded in the mounting direction of the rotor, it preferably comprises an upper region having an essentially cylindrical outer contour, and a region shaped as a truncated cone adjoining the upper region. The combination of cylindrical region and truncated cone region enables easy centering of the rotor on the drive head. Particularly, secure positioning is achieved if a further cylindrical region adjoins the truncated cone region.

Besides the drive head, the present invention further relates to a kit for a centrifuge which comprises the drive head and a hub for a rotor. The hub for the rotor may either be integrated in the rotor itself so as to form a single piece, or it may be a separate part that is inserted in an internal opening of the rotor. In the latter case, the hub is generally designed as sleeve-shaped. The hub has at least one locking surface, which runs perpendicularly to the axis of rotation of the drive head and serves to accommodate the resting surface of a coupling element. If the hub is positioned on the drive head and thus the coupling elements are in their locking position, the resting surfaces come to rest on the at least one locking surface and in this manner lock the rotor associated with the hub to the drive head. In one possible variant, a separate locking surface exists for each resting surface of a coupling element. For easier manufacturing, it is, however, preferred to provide one common locking surface for several or all resting surfaces. Such common locking surface can be designed in a ring shape, in particular, in such a manner that it makes contact with the resting surfaces of the at least two coupling elements of the drive head in the locking position if the hub is positioned on the drive head. In the hub, or the rotor, only one locking surface therefore needs to be created, the contact surface of which can moreover extend horizontally, which facilitates the manufacturing of the hub or the rotor considerably compared to the prior art. Manufacturing can be facilitated further if a recess is created in the hub, one wall surface of which forms the locking surface, and which has a rectangular cross-section in the radial direction.

The present invention finally also relates to a centrifuge which comprises either the described drive head or the kit according to the present invention.

BRIEF DESCRIPTION OF THE DRAWINGS

The present invention is explained below in greater detail with reference to the attached figures. The figures are merely schematic and only serve to describe several preferred embodiments, which, however, are not to be understood as restricting the present invention. Like reference numerals denote like components. In the schematic figures:

FIG. 4 is a cross-sectional partial view of an alternative drive head with an attached hub; and FIG. 5 is a cross-sectional view of a centrifuge according to the present invention.

DETAILED DESCRIPTION OF THE INVENTION

Figure 1:
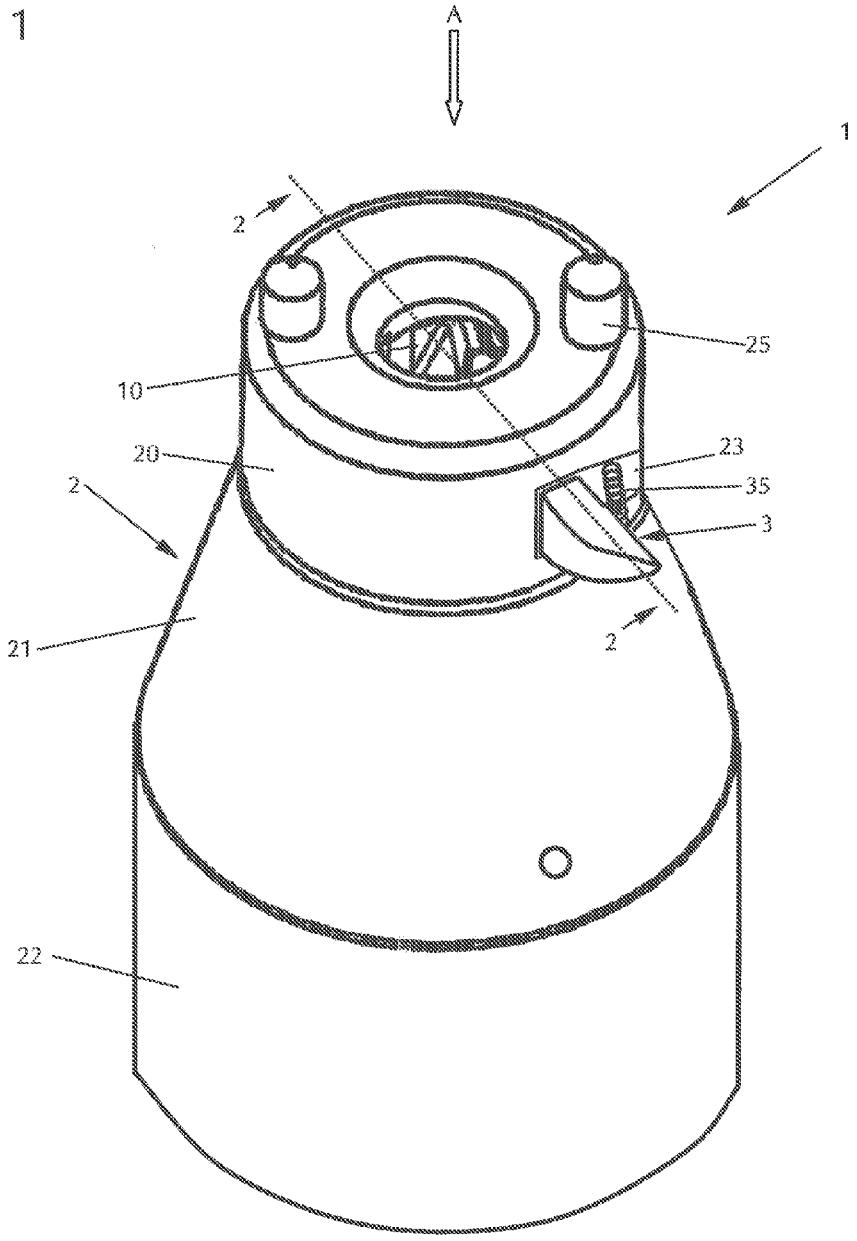
FIG. 1 is a perspective view of a drive head according to the present invention.
Figure 2:
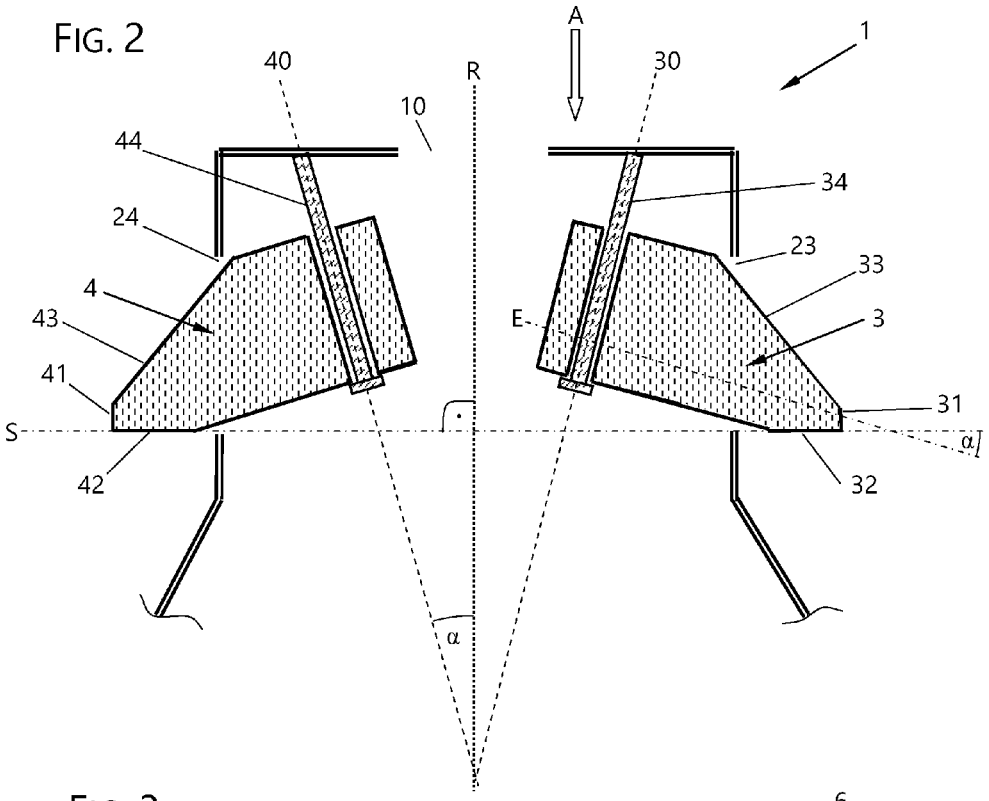
FIG. 2 is a cross-sectional partial view of the drive head of FIG. 1 taken along the line 2-2 of FIG. 1.

FIG. 1 shows a perspective view of a drive head 1 according to the present invention. This drive head is fixed to a drive shaft of a motor of a centrifuge that is not illustrated here and serves the purpose of driving a centrifuge rotor. The drive head 1 comprises a base body 2 with an essentially cylindrical upper region 20 and an adjoining region 21 shaped as a truncated cone, which is in turn adjoined by a cylindrical lower region 22. In the upper cylindrical region 20, two elongated openings are provided in the outer circumference of the base body 2 which extend along the circumference for accommodating a respective coupling element, of which only the coupling element 3 on the front side is shown here together with its associated receiving opening 23. The opening for accommodating the coupling element 4 (see FIG. 2), which is not shown, extends in a like manner on the rear side of the base body 2. The coupling elements 3 and 4 are swivel-mounted in the openings 23, 24 and are biased with the help of a respective spring element 35 in such a way that they are pushed out of the receiving opening to their locking position. In FIGS. 1 and 2, the two coupling elements 3 and 4 are in their locking position, in which they protrude to the outside beyond the outer circumference of the cylindrical region 22 of the base body 2 with their outer ends 31, 41, so that their resting surfaces 32, 42 protrude over the base body 2.

While attaching a rotor in the mounting direction A on the drive head 1 or while unlocking, the coupling elements 3 and 4 are pushed back into the base body 2 to such an extent that the ends 31, 41 of the coupling elements 3 and 4 either do no longer protrude beyond the outer circumference of the base body 2, or only to such an extent that the rotor can be removed from the drive head 1. The outer contour of the coupling element 3 is curved and follows the progression of the outer contour of the cylindrical region 20 of the base body 2. Thus, in the release position, in which the rotor can be removed from the drive head, the coupling element 3 disappears completely in the opening 23 in the base body 2 and both surfaces extend flush with each other. The same applies to the coupling element 4, which is not shown here. The pin-shaped projections 25 serve to align and hold the rotor, which has corresponding recesses for accommodating the projections 25, on the drive head 1. A central opening 10 in the upper region of the drive head 1 enables the access to the internal area of the drive head and thus facilitates the installation and maintenance of the coupling elements 3 and 4 inside the drive head 1.

FIG. 2 shows a sectional view of the drive head 1 of FIG. 1 taken along the line 2-2 of FIG. 1 in an upper area of the drive head. The coupling elements 3 and 4 are each swivel-mounted on a respective supporting rod 34, 44 attached to the base body 2, so that they can be swiveled between the release position and the locking position as shown here. The supporting rods 34, 44, and thus the swivel axes 30, 40, about which the coupling elements 3 and 4 can be swiveled, are inclined with respect to the axis of rotation R about which the drive head is rotated, in such a way that the swivel axes 30, 40 extend towards each other in a V-shape manner as regarded from the mounting side A, the tip of the V being remote from the mounting side. The coupling elements 3 and 4 thus carry out a swiveling movement in a respective plane E, which, with respect to a plane intersecting the axis of rotation R perpendicularly and originating from the latter at an angle, is inclined outwardly and away from the mounting direction A. The inclination angle between said plane and the horizontal plane corresponds to the angle at which the axis of rotation and the swivel axes 30, 40 intersect, and is designated here with $\alpha$. The plane E can be ascertained by selecting any point within the coupling element and observing it during the swiveling process. The plane E includes the path of motion of this point during swiveling about the swivel axis. In contrast thereto, the resting surfaces 31, 41, via which the coupling elements 3 and 4 come to rest on an associated locking surface of the hub of the rotor, are implemented as horizontal and lie in the sectional plane S intersecting the axis of rotation perpendicularly.

As already described in DE 10 2008 045 556 A1, the holding force with which the drive head and the rotor are attached to each other on the one hand depends on the static friction coefficient between the contact surfaces of the rotor and the drive head, in this case the resting surface of the coupling element and the locking surface of the rotor hub, and thus on the material properties of the two surfaces, and, on the other hand, on the inclination angle with respect to the direction of the applied force. Steel is often used as the material for the contact surfaces. For a steel-steel combination for the resting surface of the coupling element and the locking surface of the rotor, the friction coefficient $\mu_0$ is approximately 0.3. In order to achieve self-locking between the two contact surfaces and thus to prevent unintended detachment of the two surfaces from each other, the inclination angle $\alpha$ should be smaller than arc tan $\mu_0$. The maximum angle $\alpha$ for a steel-steel combination is therefore 17°. In the case shown here, the angle $\alpha$ is set to approximately 15°. For other material combinations, a different angle may however be chosen.

A great advantage of the inclined coupling elements according to the present invention, compared to the prior art as described above, resides in the fact that the resting surfaces 32 and 42 of the coupling elements 3 and 4 can be designed as horizontal. Accordingly, the locking surfaces of the rotor hub are horizontal as well. This facilitates their manufacturing significantly compared to the prior art. For example, it is possible to use a horizontal upper edge of the rotor hub as locking surface for the coupling elements. In another variant, which is described in FIGS. 3 and 4, horizontal grooves in the rotor hub are used as locking surface instead of grooves which must have a specific inclination.

Figure 3:
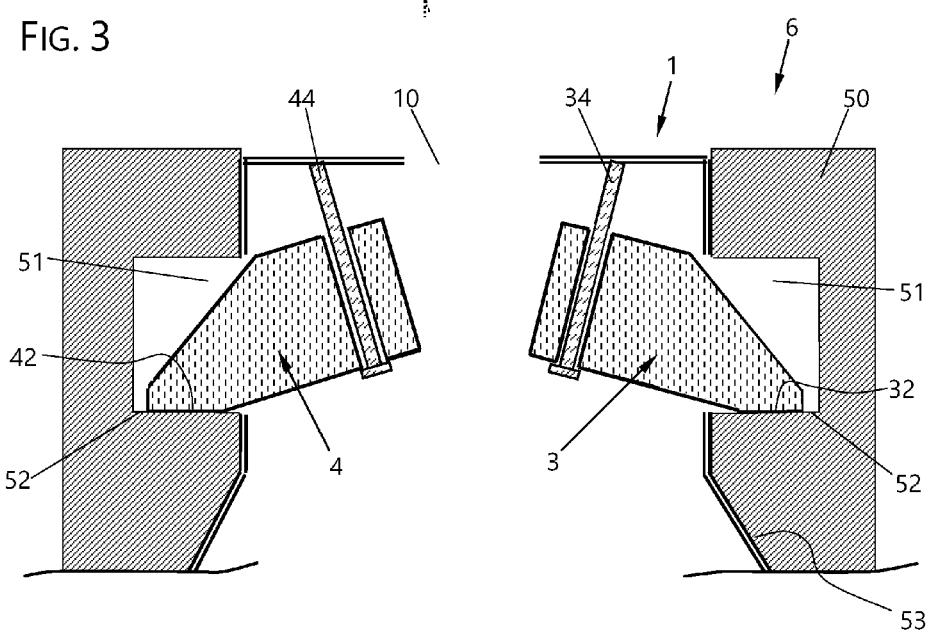
FIG. 3 shows the drive head of FIG. 2 with an attached hub of a rotor.

FIGS. 3 and 4 show different embodiments of a kit 6 according to the present invention comprising a drive head 1 and an associated hub 50 that is normally mounted in the internal opening of an associated rotor. FIG. 3 shows a hub 50 for the drive head of FIG. 2. The hub 50 essentially has a sleeve-like shape. Its inner cavity has a central passage opening, the inner contour of which follows the outer contour of the drive head 1, so that the hub 50 fits tightly on the drive head in the mounted state, in which it can be locked on the drive head. Only the upper part of the drive head and the hub is shown here, i.e., the cylindrical upper region and a part of the truncated cone region. While being put over, the tapering truncated cone-like jacket 53 of the hub 50 pushes the coupling elements 3 and 4 inwards against the spring load of the spring elements 35, which are not shown in FIG. 3, until they are inserted completely in the base body 2 of the drive head 1, and are thus in the release position, upon reaching the cylindrical region of the passage opening of hub 50. If the hub 50 is pushed further downwards over the drive head 1 and thus the ring-like locking surface 52 passes the coupling elements 3 and 4, the coupling elements are released, swiveled outwards about the supporting rods 34, 44 into the locking positions, swivel into the recess 51, and thus come to rest flat with their resting surfaces 32 and 42 on the ring-like locking surface 52 of hub 50. By means of the coupling elements swiveling outwardly into the recess 51, which has a rectangular cross-section in the radial direction and is therefore very easy to manufacture, the hub 50 is locked at the drive head 1 without any further assistance of the user being required. An unintended detaching of the hub and the drive head from each other is no longer possible. Separation of the two parts can only be achieved by actuating an actuation device which is not shown here but is basically known from the prior art, by means of which the coupling elements 3 and 4 are moved into the release position against the spring load exerted by springs 35.

FIG. 4 shows a refinement of the kit of FIG. 3. In addition to the coupling elements 3 and 4, which are identical in FIGS. 1 to 3, a second type of coupling elements is provided here, which differs from the other coupling elements in terms of size and mass. The two smaller coupling elements, here 3 and 3', correspond to the coupling elements 3 and 4 of FIGS. 1 to 3. In addition to these, two further coupling elements 4, 4' are present at the upper end of the drive head 1, which are larger and heavier than the coupling elements 3, 3'. Thus, there are two pairs of coupling elements, 3, 3' on the one hand and 4, 4' on the other hand. Which pair of coupling elements is used, depends on the intended application and is determined by appropriate selection of the rotor hub 50. Thus, in this case, there is more than one hub for the shown drive head, namely, two or three hubs. The hub shown in FIG. 4 is intended for use in the set 6 at low rotational speeds of the centrifuge. A strong self-locking is desired even for such low rotational speeds and is achieved here by using larger and heavier coupling elements. The hub 50 is designed in such a way that it allows for only the heavy coupling elements 4, 4' to swivel into the recess 51, whereas no recess is provided for the smaller coupling elements 3, 3', which therefore remain in their non-swiveled release position. For high speeds, on the other hand, a hub is used that has a circular recess, as shown in FIG. 3, whereas no recess is provided in the area of the coupling elements 4, 4', so that in this case it is the heavy coupling elements that remain in the release position. The lighter coupling elements are less prone to getting wedged at high rotational speeds, and thus allow for a secure detachment of the rotor from the drive head after centrifugation. A third variant may have recesses for the coupling elements 3, 3' as well as for the coupling elements 4, 4', so that all four coupling elements contribute to locking of the rotor at the drive head. For other possible details, reference can be made to DE 10 2012 011 531 A1.

Finally, FIG. 5 shows, in a greatly simplified form, a centrifuge 7 according to the present invention, which is, for example, a floor standing centrifuge. The use of the present invention in smaller equipment like a bench-top centrifuge is basically also feasible. Inside an external housing 70 there is disposed a rotor housing 71, in which a centrifuge rotor 5 is disposed. Said rotor is in turn connected to a hub 50 that is fitted to a drive head 1 and is locked in position on the latter as described above by means of coupling elements, which are not shown here. The rotor 5 is caused to rotate by means of a motor 72 via a drive shaft 73.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. A drive head associated with a drive for detachable connection of the drive with a rotor of a centrifuge, comprising:

a base body which is rotatable about an axis of rotation (R) and at least two coupling elements, which are mounted on the base body so as to be able to swivel out to an outside about a respective swivel axis, wherein the swivel axes are tilted at an angle ($\alpha$) not equal to 90° with respect to the axis of rotation (R), and the coupling elements at their swiveling end have a resting surface extending perpendicularly to the axis of rotation (R) when the coupling elements are swiveled to the outside.

2. The drive head according to claim 1, wherein the angle ($\alpha$) is between 5 and 30°.

3. The drive head according to claim 1, wherein the resting surface is arranged on a side of the coupling elements opposite to a mounting side (A) of the rotor.

4. The drive head according to claim 1, wherein the coupling elements taper in a direction towards the swiveling end and have an upper cover face which points in a direction towards a mounting side (A) of the rotor and is implemented as sloping downwards in a direction towards the swiveling end.

5. The drive head according to claim 1, wherein at least two of the at least two coupling elements differ from each other with respect to at least one of the following characteristics:

external shape, mass, material, mounting level on the base body with respect to the axis of rotation (R).

6. The drive head according to claim 1, wherein multiple coupling elements are arranged one above the other in the direction of the axis of rotation (R).

7. The drive head according to claim 1, wherein the base body comprises, relative to a mounting direction of the rotor, an upper region having an essentially cylindrical outer contour and, adjoining said upper region, a region shaped as a truncated cone, the coupling elements being arranged in at least one recess of the upper region adjacent to the truncated cone-shaped region.

8. The drive head according to claim 7, wherein said truncated cone is adjoined by a cylindrical lower region.

9. A kit for a centrifuge,
wherein said kit comprises a drive head according to claim 1 and a hub for a rotor.

10. The kit according to claim 9,
wherein the hub has a recess running in a circumferential direction.

11. The kit of claim 10,
wherein the recess comprises a circular recess having a rectangular cross-section in a radial direction.

12. The kit according to claim 9,
wherein the kit further comprises a rotor which can be connected or is connected with the hub of the kit.

13. A centrifuge,
wherein said centrifuge comprises a kit according to claim 9.

14. A centrifuge,
wherein said centrifuge comprises a drive head according to claim 1.

15. The drive head of claim 1,
wherein the angle ($\alpha$) is between 10 and 20°.

16. The drive head of claim 1,
wherein the angle ($\alpha$) is between 13 and 17°.

17. The drive head according to claim 1,
wherein one of the at least two coupling elements is larger and/or heavier than another of the at least two coupling elements.

* * * * *